United States Patent [19]

Gerwick, Jr. et al.

[11] 4,422,804

[45] Dec. 27, 1983

[54] GRAVITY BASE OF OFFSHORE PRODUCTION PLATFORM WITH ICE-PENTRATING PERIPHERAL NOSE SECTIONS

[75] Inventors: Ben C. Gerwick, Jr., Oakland, Calif.; Edward B. Price, Dallas; Thomas P. Taylor, Duncanville, both of Tex.

[73] Assignee: Mobil Oil Corporation, New York, N.Y.

[21] Appl. No.: 329,372

[22] Filed: Dec. 10, 1981

[51] Int. Cl.[3] ..... E02B 17/00

[52] U.S. Cl. ..... 405/210; 405/211

[58] Field of Search ..... 405/31, 195, 203, 205, 405/207, 210, 211, 217; 114/40, 41, 42

[56] References Cited

U.S. PATENT DOCUMENTS

| | | | |
|---|---|---|---|
| 3,672,175 | 6/1972 | Mason | 114/41 X |
| 4,019,332 | 4/1977 | Lamy | 405/211 |
| 4,118,941 | 10/1978 | Bruce et al. | 405/207 X |
| 4,189,252 | 2/1980 | Inman | 405/195 X |
| 4,215,952 | 8/1980 | Baardsen | 405/211 |

*Primary Examiner*—David H. Corbin

*Attorney, Agent, or Firm*—A. J. McKillop; M. G. Gilman; J. F. Powers, Jr.

[57] ABSTRACT

A gravity base offshore production platform structure and, more particularly, a production platform for use in an arctic environment, including an encircling structure having a predetermined configuration the protection of the offshore structure in iceberg-infested waters which are capable of resisting the destructive forces of an impact produced by a large iceberg. The gravity base offshore production platform structure consists of a monolithic, massive concrete structure of a configuration providing a plurality or horizontal array of upright, mostly cylindrical compartments, which is supported on a concrete or slab foundation nesting on the marine floor. Generally, although not necessarily, the compartmented structure rises above the marine surface and is covered by a concrete slab or similar covering structure to thereby form closed compartments within the monolithic structure. The circumference of the concrete structure incorporates a plurality of ice-deflecting nose portions which are integrally formed with the wall structure of the exteriorly located compartments of the array, and are reinforced to withstand large iceberg forces upon impact. These reinforced nose portions impart either a "scallop-like" configuration to the circumference of the structure, or when in the shape of substantially pointed wall sections, a "starpoint" form capable of resisting and absorbing extremely high energy of large, fast moving and strong icebergs by progressively crushing the leading edge of an impacting iceberg.

13 Claims, 9 Drawing Figures

GRAVITY BASE OF OFFSHORE PRODUCTION PLATFORM WITH ICE-PENTRATING PERIPHERAL NOSE SECTIONS

BACKGROUND OF THE INVENTION

1. Field of the Invention

The present invention relates to a gravity base offshore production platform structure and, more particularly, a production platform for use in an arctic or sub-arctic environment, including an encircling structure having a predetermined configuration, giving protection to the offshore structure in iceberg-infested waters. This structural configuration is capable of resisting the destructive forces of an impact produced by an iceberg.

More recently, the increased worldwide demand for hydrocarbons such as oil and natural gas, has necessitated the investigation and exploitation of many new regions throughout the world, both on land and offshore. One of the regions which appears to be extremely promising in its potential for finding hydrocarbon fuels is the offshore arctic and sub-arctic area in proximity to Canada and Greenland. However, this area calves numerous icebergs each year. The size and shape of these are dependent upon their glacial source, climatic and hydrographic conditions determinative of their survival or deterioration, and the routes and distances over which the icebergs travel. Some of these icebergs reach a very large magnitude and, when impacting against a structure, produce immense destructive forces.

The offshore production platform, especially the support section thereof which is submerged below the marine surface, is exposed to the impact of large icebergs. In addition to experiencing localized or massive failures in the structure thereof, it can to some extent slide along the marine floor, conceivably causing damage to expensive and difficultly replaceable equipment, wall casings and pipelines connected to the platform support structure. In order to counteract any substantial or massive foundation or support section failure of the offshore platform, the submerged support section of a self-protecting type of platform should be impressive in its mass and dimensions so that possible failure of structural and foundation components are limited to localized areas. While these localized areas may conceivably fail under the impact of large icebergs having extremely strong ice, this should occasion only a brief and temporary supension of platform operations when such an impact encountered reaches a maximum or extreme limit. The localized impact from very strong ice may cause flexural and shear failure which extends progressively into the structure, rupturing oil tanks. The global or overall energy of the impacting icebergs, if not absorbed by some local energy absorbing means, may cause the entire structure to slide or tilt, thereby resulting in great economic loss.

2. Discussion of the Prior Art

Various solutions to the problems encountered in protecting offshore structures from damage caused by iceberg impact in iceberg-infested waters have been suggested in the prior art. Thus, Pearce et al. U.S. Pat. No. 4,245,929 discloses an offshore structure able to withstand ice forces generated by impinging ice sheets or icebergs in which at least the lower portion of the support structure of the offshore platform includes upper and lower differently sloped conical portions with respect to the walls thereof forming an inclination relative to the horizontal so as to receive and deflect ice masses moving into contact with the platform support structure. The particular structural selection of the conical wall structure is designed to cause the ice to tilt upwardly upon impinging against the support structure and to fragment itself while sliding off the support structure. The type of conical wall structure proposed in Pearce et al. does not appear to be adequate to withstand the impact of extremely large icebergs encountered in arctic or subarctic waters and is primarily intended for the purpose of deflecting relatively thin ice sheets rather than large and massive icebergs.

Howard U.S. Pat. No. 3,766,737 discloses an offshore platform which is encompassed, at a radial distance from the platform, by a circumferentially movable ice trenching machine which will circulate about the platform so as to fragment and remove ice in a circular path at a rate approximately equal to the rate of movement of the ice sheet towards the protected structure. Also this type of protective arrangement for offshore platforms is only adapted to protect the platform from the pressures of ice sheets and does not appear to provide any significant protection against the large destructive forces generated through impact by a massive iceberg.

Challine et al. U.S. Pat. No. 4,142,819 discloses an offshore platform in which the platform is of the gravity-type including a base resting on the marine floor and with an annular shell affording rigidity in the upward direction, such as a circular wall and diaphragms extending about the base portion of the platform so as to provide reinforcement therefore. This type of reinforcing support structure for the base of the offshore platform does not appear to be designed to withstand the impact of icebergs, particularly any relatively large and massive icebergs normally encountered in arctic and sub-arctic waters and thus would provide inadequate protection for the platform, thereby rendering it unsuitable for use in iceberg-infested waters.

SUMMARY OF THE INVENTION

In essence, the gravity base offshore production platform pursuant to the present invention which incorporates the protective subsea support structure for the offshore platform itself is adapted to protect a marine bottom-supported platform from the impact of and resultant damage caused by massive icebergs.

The present invention envisions a gravity base offshore platform structure designed to absorb the energy of an impacting iceberg by causing local crushing failure of the ice, thus bringing it gradually to a stop and limiting the maximum force developed, so that the structure does not slide nor tilt.

The gravity base offshore platform is a cellular or compartmented concrete structure of a monolithic and integral construction which may be constructed in a well known and conventional manner, in essence, similar to and in a like manner as employed in the construction of concrete piers, caissons and dry docks, nuclear reactor caissons, and offshore gravity base structures in the North Sea.

Accordingly, it is a primary object of the present invention to provide gravity base offshore production platform with an integral structure, configured so as to protect the production platform in iceberg-infested waters. It is adapted to be utilized in the exploitation of arctic and sub-arctic offshore areas in which icebergs are likely to be encountered during at least some seasons of the year.

It is a more specific object of the present invention to provide a gravity base support structure for the protection of offshore platforms of the type described which consists of a massive compartmentalized concrete structure resting on the marine bottom and extending upwardly towards the marine surface in an encircling and protective relationship about the offshore production platform, while being integrally constructed therewith.

In essence, the gravity base offshore production platform structure consists of a monolithic, massive concrete structure of a configuration providing a plurality or horizontal array of upright compartments, which is supported on a concrete or slab foundation resting on the marine floor. Generally, although not necessarily, the compartmented structure rises above the marine surface and is covered by a concrete slab or similar covering structure to thereby form closed compartments within the monolithic structure.

The circumference of the concrete structure incorporates a plurality of ice-penetrating nose portions which are integrally formed with the wall structure of the exteriorly located compartments of the array, and are reinforced to withstand large iceberg forces upon impact. These reinforced nose portions impart either a "scallop-like" configuration to the circumference of the structure, or when in the shape of pointed wall sections, a "starpoint" form capable of resisting and absorbing extremely high ice loads by progressively crushing the leading edge of an impacting iceberg. Radially extending partition walls arranged within the circumferentially outer located compartments so as to form small ballasting compartments about the circumference of the structure are designed to absorb the maximum anticipated ice thrust forces and punching shear. This will allow for toleration of inelastic stresses and local punching failures of the outer compartment structure since this would be encountered normally in only one or at most a few compartments for any maximum impact force exerted by an extremely strong iceberg.

In one specific embodiment of the invention, the outer circumference of the monolithic structure has a generally hexagonal configuration, with the reinforced nose portions being located at each of the corners of the hexagon. In a modification thereof, when utilizing a structure having the pointed nose portions, the latter may also be located intermediate the corners of the "starpoint" arrangement.

The array of compartments within the monolithic support section for the gravity base offshore platform may include several compartments or shafts, whose walls extend above the remaining compartments and form supports or uprights for the production platform. These shafts may comprise a drill shaft, riser shaft and utility shaft, the functions of which are well known in the technology.

In one of the preferred embodiments of the invention, the remaining compartments may be employed as oil storage cells, with the exception of the corner compartments having the nose portions thereon, and the smaller compartments about the structure circumference, which may be filled with water or discrete crushable material. In another embodiment, all of the remaining compartments, with the exception of the small compartments about the circumference of the monolithic structure, are oil storage compartments. Ballast compartments may be provided above each of the oil storage compartments or cells so as to increase the sliding resistance of the structure.

BRIEF DESCRIPTION OF THE DRAWINGS

Reference may now be had to the following detailed description of exemplary embodiments of gravity base support offshore production platform structures pursuant to the invention, taken in conjunction with the accompanying drawings; in which.

DETAILED DESCRIPTION

Figure 1:
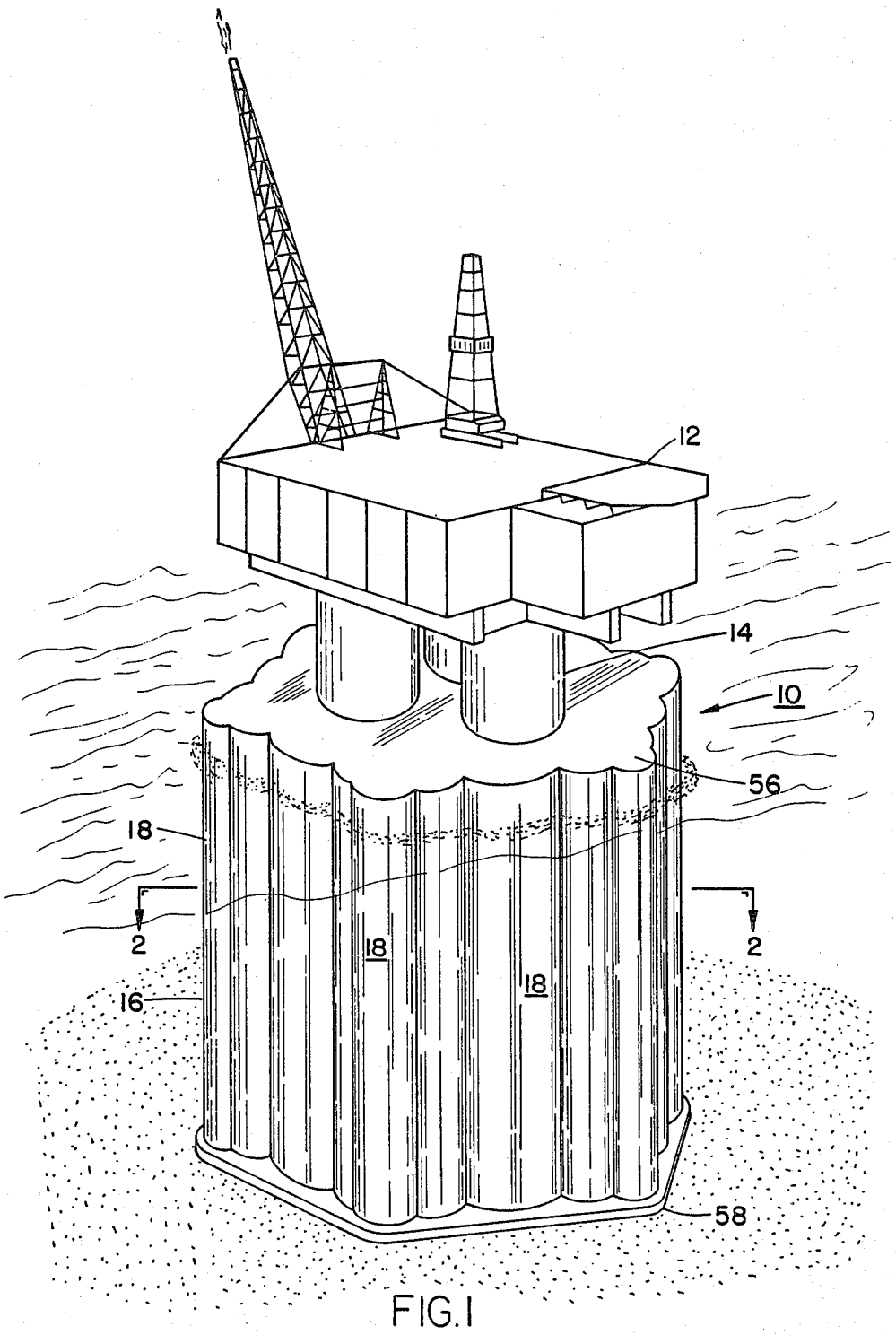
FIG. 1 illustrates a perspective view of a gravity base support offshore production platform incorporating the inventive support structure.
Figure 2:
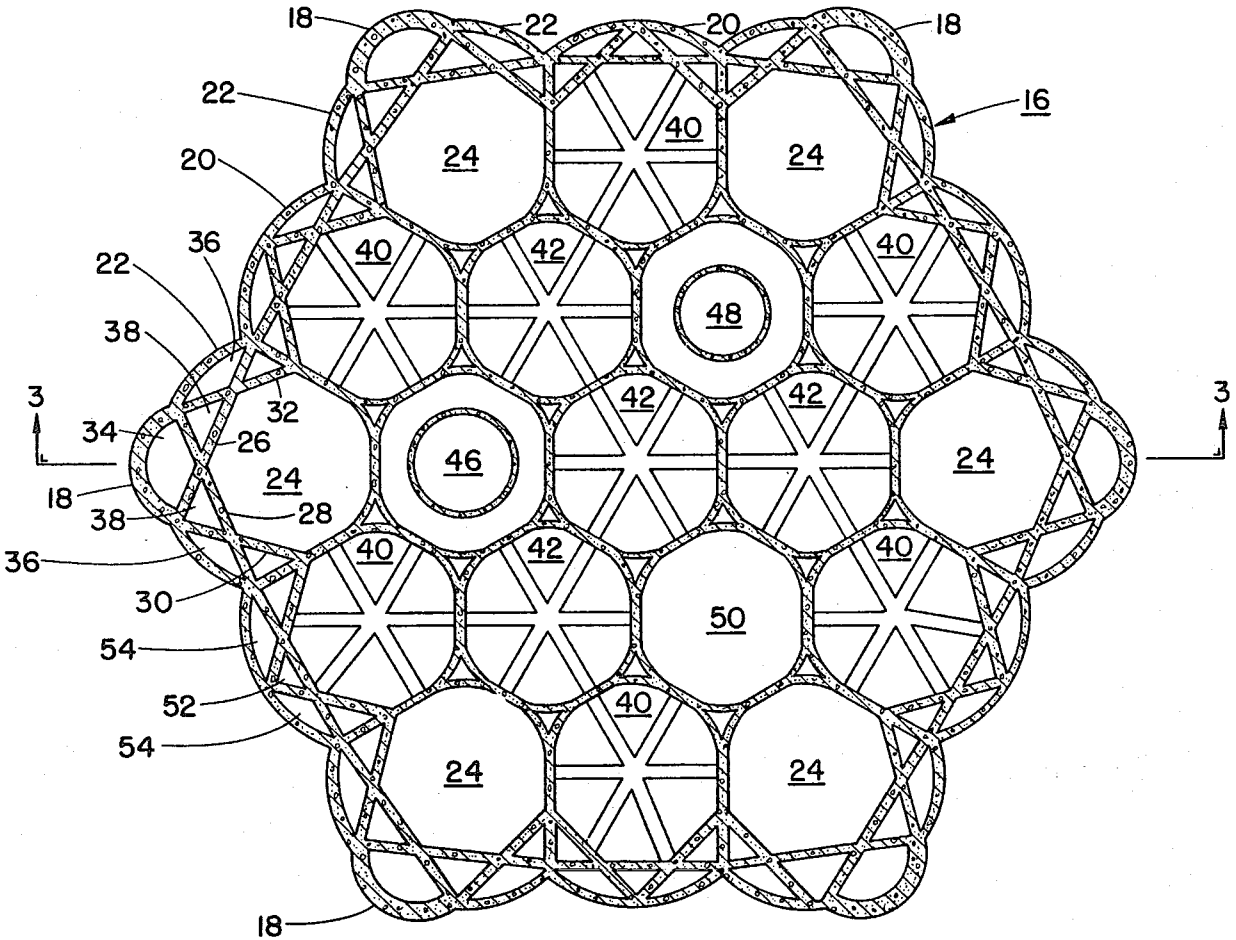
FIG. 2 is a plan sectional view taken along line 2—2 in FIG. 1.
Figure 3:
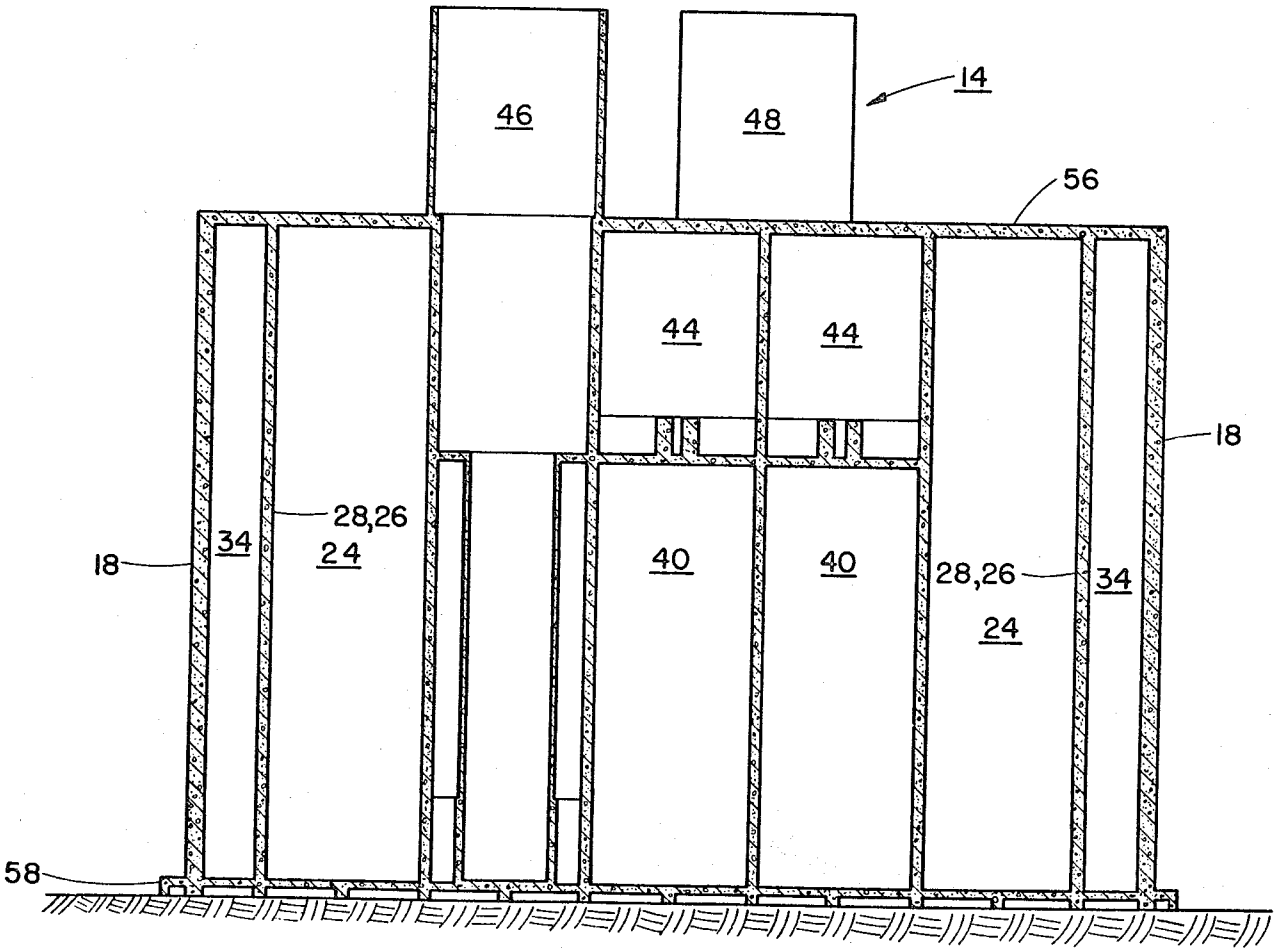
FIG. 3 is a vertical sectional view of the support structure for the offshore production platform taken along line 3—3 in FIG. 2.

Referring now in detail to the embodiment illustrated in FIGS. 1 through 3 of the drawings, a gravity base offshore production platform structure 10 includes an above-water platform section 12 supported on a support section 14 which extends downwardly towards the marine floor and is encompassed by an integrally constructed massive or monolithic annular encompassing structure 16 resting on the marine bottom.

The massive or monolithic encompassing structure 16, which may be in excess of 100 meters in diameter, as illustrated more closely in the section shown in FIG. 2 of the drawings, consists of a plurality or horizontal array of cells or compartments formed by a monolithic concrete structure, preferably prestressed and reinforced concrete commonly employed in marine caisson, dry dock and pier construction. In the illustrated embodiment, the monolithic encompassing support structure 16 is essentially of a hexagonal configuration having six protruding nose sections 18 located along the outer corners of the hexagon in the shape of outwardly arched wall portions of greater thickness than the remaining concrete of the monolithic structure 16. The outer wall structure is formed of outwardly arched sections 20 and 22 on each side thereof flanking the protruding nose portions 18 so as to provide a generally "scallop-shaped" or "starpoint" construction. Each of the nose portions 18 and adjacent walls 22 form part of the outer circumference of a compartment 24 at each of the six corners of the hexagonal structure which through the intermediary of reinforcing internal concrete partition walls 26, 28, 30 and 32, is subdivided into further small outer compartments 36 and 38.

The structure 16 includes a plurality of compartments 40 located along the outer circumference of the compartment array which are positioned intermediate adjacent corner compartments 24. Moreover, arranged within the structure interiorly of the location these compartments is a further sub-array of compartments 42.

Compartments 40 and 42 as shown in further detail in FIG. 3, consists of oil storage cells or compartments which are located in at least the lower portion of the encompassing structure 16. Optionally, if desired, ballast compartments 44 may be arranged above the oil storage cells 40, 42 so that as oil is pumped out of these cells, it may be replaced by seawater being pumped into the ballast compartments 44. This sea water is employed to not only provide weight compensating for the oil removed but also to offset the external hydrostatic load acting on the structure. Arranged at equidistant annular spacings about the central oil storage compartment 42 of the compartment array are, respectively, a utility shaft compartment 46, a riser shaft compartment 48, and a drill shaft compartment 50 which are employed in the operation of the offshore production platform. The concrete wall structure which forms or encompasses the compartments 46, 48 and 50 projects upwardly beyond the monolithic encompassing structure 16 so as to form support legs or conduit structure 14 for the above-water platform section 12, and communicates with the particular modules constituting that platform. These modules may include the operating personnel living quarters, storage and work shops, wellhead structure and all components necessary for the operation of an offshore production platform.

Generally, although not necessarily, the compartments 24, 34 and 36 are filled with suitable ballast material, such as compacted sand or iron ore although it is possible to contemplate that at least compartments 24 may also serve as oil storage compartments, with the major shock loads generated through impact by a massive iceberg being primarily absorbed by the peripheral structure.

Similarly, the compartments 52 and 54 located along the outer perimeter of compartments 40 intermediate the compartments 24 may also be filled with suitable ballast, such as compacted sand or iron ore or compressible material such as expanded shale.

The top of the monolithic structure 16 is adapted to be closed off by means of a suitable concrete slab 56, and with the entire structure, including the platform support structure 14 and the platform 12 being supported on a concrete slab or base 58 resting on the marine floor.

If desired, the outer surface or at least the corner portions 18 of the monolithic structure 16 may be covered with steel plates or sheathing to further aid in protecting the structure from the local abrasion and impact forces produced by a large or massive iceberg impinging against the structure.

Figure 4:
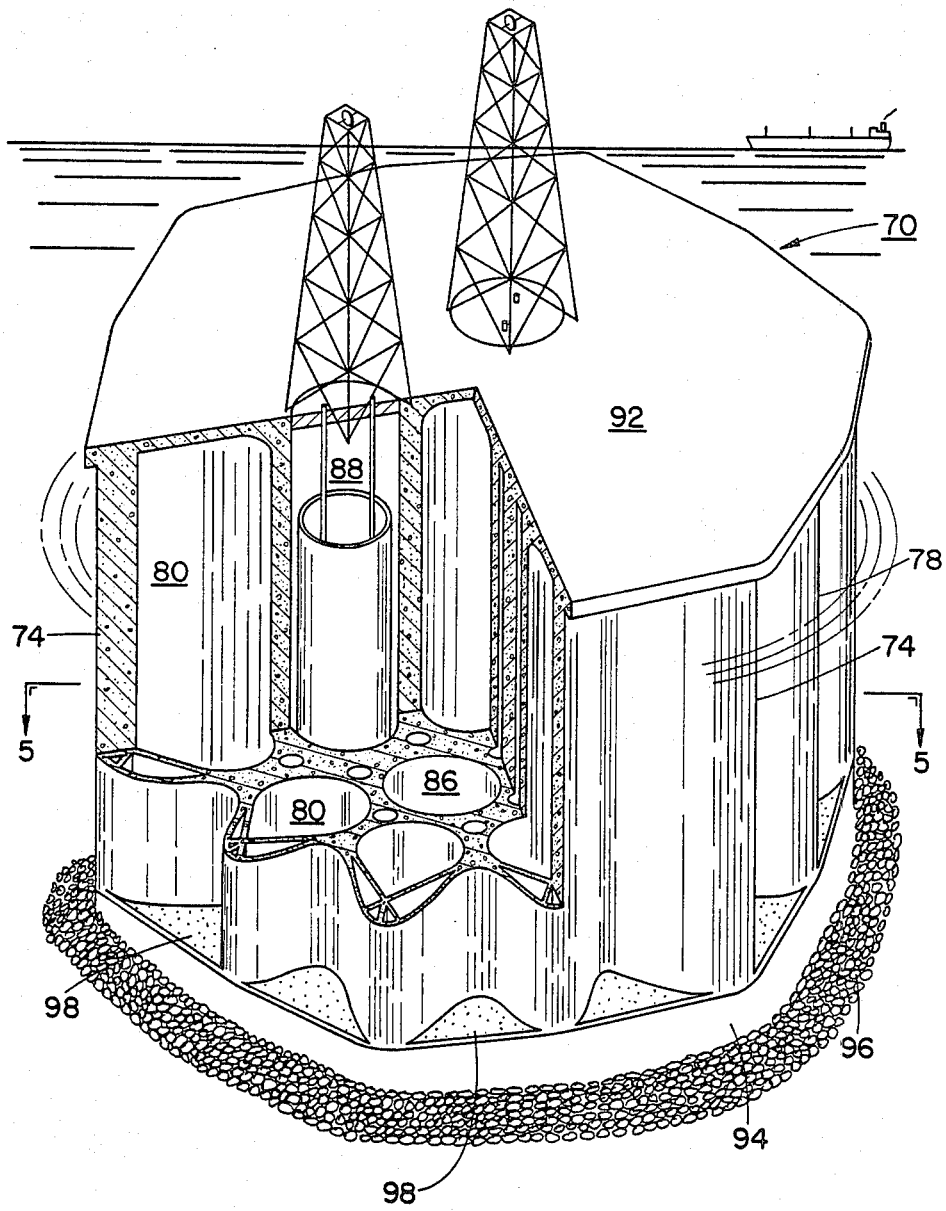
FIG. 4 is a perspective view, partly broken away, of a second embodiment of a gravity base support offshore production platform structure.
Figure 5:
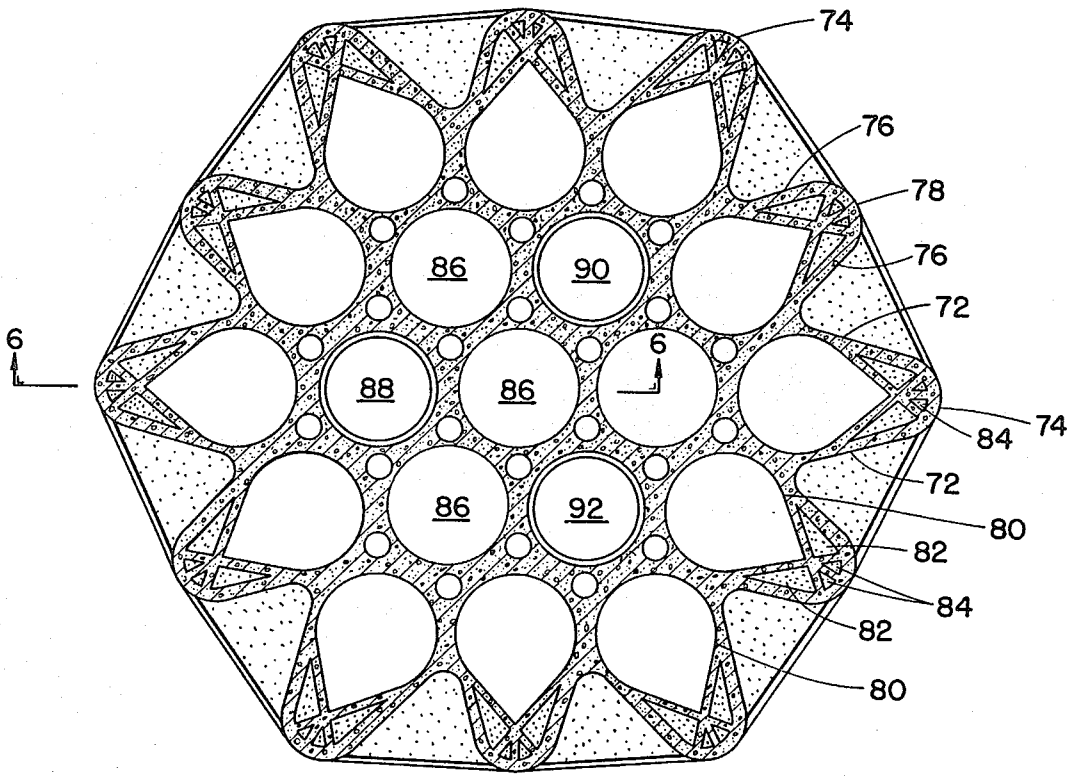
FIG. 5 is a plan sectional view taken along 5—5 in FIG. 4.
Figure 6:
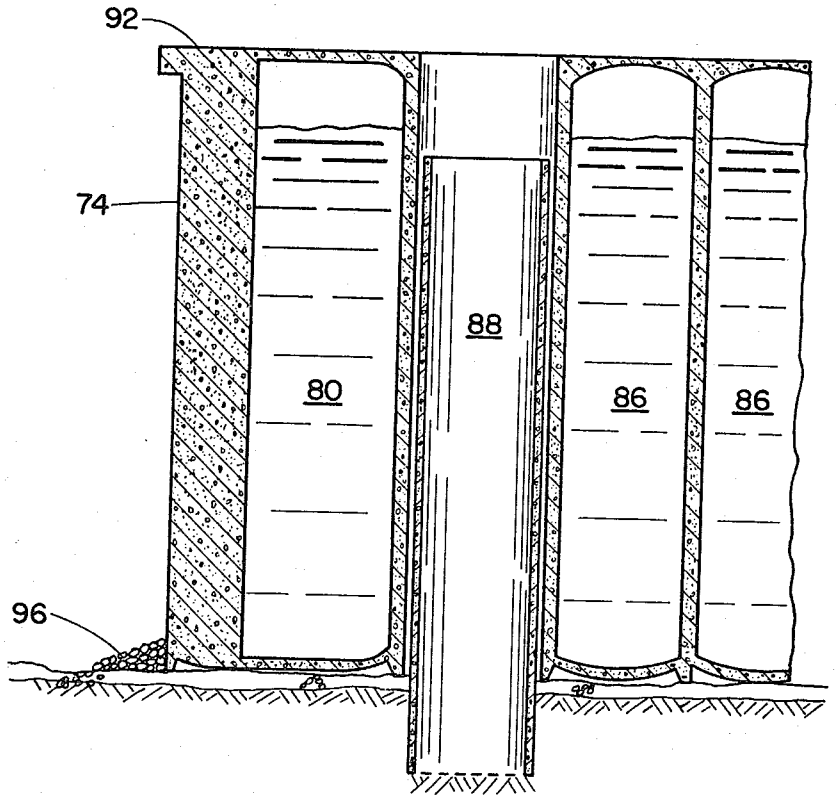
FIG. 6 is a vertical sectional view taken along line 6—6 in FIG. 5.

The embodiment illustrated in FIGS. 4 to 6 of the drawings is somewhat similar in function and construction to that of FIGS. 1 and 3; however, in this instance the platform structure 70 includes an outer wall arrangement including a plurality of generally upright walls 72 conically converging at the hexagonal corners and interconnected near their apices by an outer arcuate reinforced nose wall section 74. Also included between each of the corners are further starpoint sections of similar conical construction each with converging side walls 76 and a reinforced rounded nose wall portion 78.

The entire structure, as shown more specifically in FIG. 5, includes a plurality or array of compartments 80 extending about the outer circumference of the concrete structure, having the outer nose sections thereof, which are in the shape of "starpoints" formed into compartments 82 and 84, filled with a ballast, such as water or sand or iron ore, and which absorb the impact of any massive iceberg striking against the structure. The large compartments 80 which are generally circular or polygonal in configuration may serve as oil storage compartments and, in turn, surround a plurality or array of inner compartments 86 which also serve as oil storage compartments and which are separated by upright concrete wall formations.

As in the previous embodiment, three equidistantly spaced compartments 88, 90 and 92 serve as, respectively drill, riser and utility shafts employed in the normal operation of the production platform. In this instance, these shafts may be of telescoping construction, with shaft 88 extending down into a subsea floor wellhead cellar for oil well operation below the monolithic structure.

Although in this embodiment the upper slab 92 is shown as supporting the offshore production platform structure directly, it will be obvious to one skilled in the art that the compartments or shaft portions 88, 90 and 92 may extend upwardly of the "starpoint" structure so as to support the platform in an elevated manner analogous to that described and disclosed in the embodiment of FIGS. 1 to 3 of the drawings.

The bottom of the structure which is formed by the starpoint sections 74 and 78, may be enclosed by a low sea wall 19 also formed of concrete, which is in turn encompassed by a gravel wall 96 for scour protection, and may have the areas 98 between the recessed portions of the starpoints filled with compacted sand.

Figure 7:
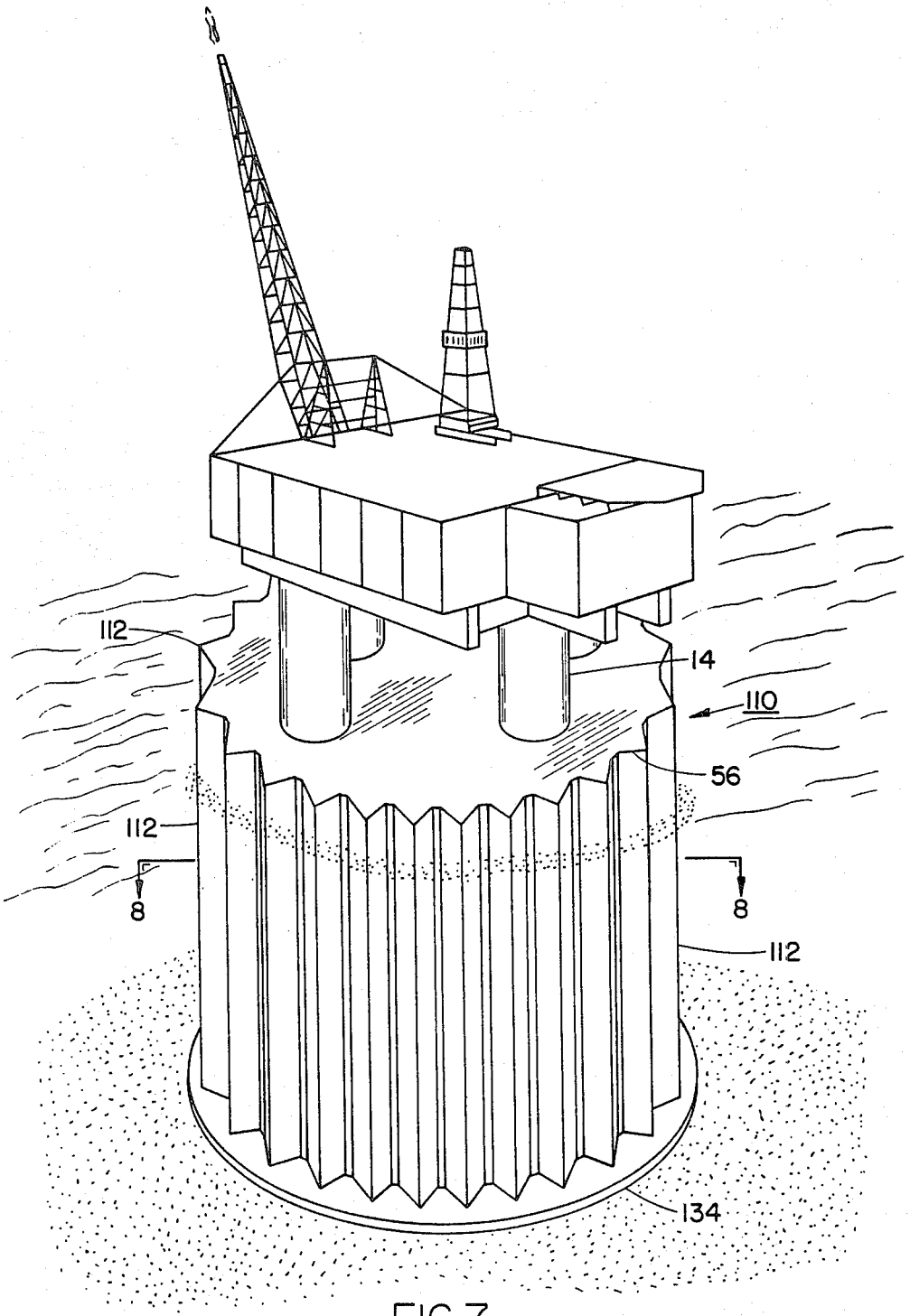
FIG. 7 is a perspective view of a third embodiment of a gravity base support offshore production platform structure.
Figure 8:
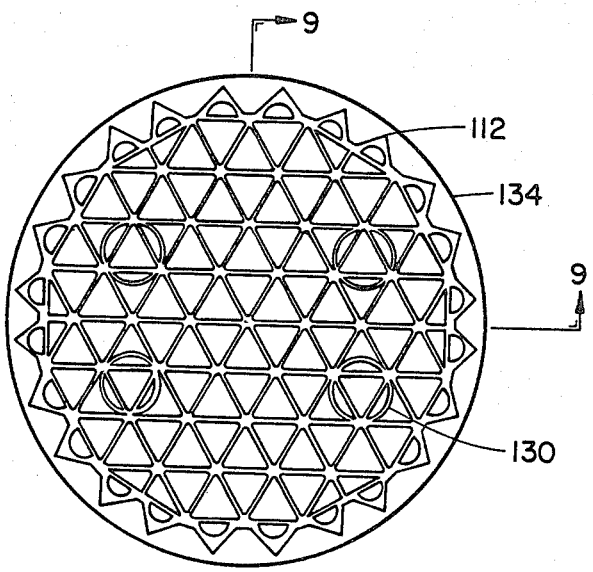
FIG. 8 is a plan sectional view taken along line 8—8 in FIG. 7.
Figure 9:
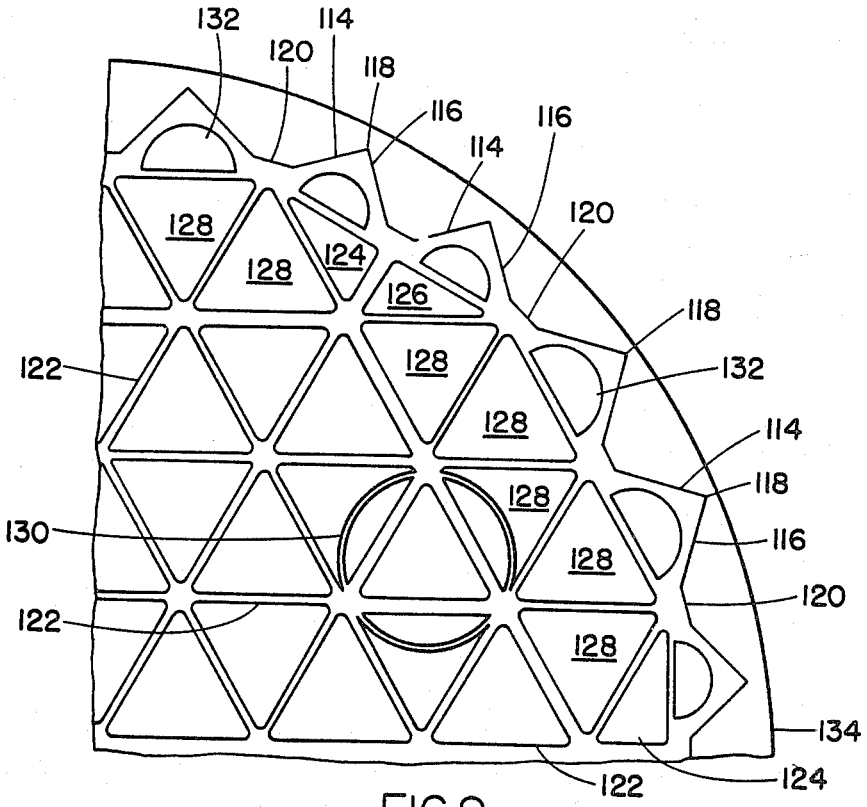
FIG. 9 is a quarter-section of the view in FIG. 8, shown in an enlarged scale.

The embodiment shown in FIGS. 7 to 9 of the drawings is similar in function and construction to that illustrated in FIG. 1; however, in this particular instance the platform structure 110 includes an outer wall arrangement in which the "starpoints" or annularly spaced wall sections 112 are in the shape of sharply pointed cones or wedges.

In essence, each nose section 112 includes a protruding conical configuration constituted of straight-sided walls 114 and 116 converging radially outwardly towards a sharp apex point 118, in the general configuration of a wedge. The base of each diverging side wall 114,116, as viewed in a radially inward direction is connected with the adjacently located base of the side wall 116,114 through the intermediary of a connecting wall 120.

The interior of the platform structure 110 is divided into a relatively large number of substantially triangular compartments through the intermediary of a plurality of walls 112 extending in the arrangement of a "honeycomb" pattern. The series of compartments 124,126 and 128 which are located along the outer periphery of the honeycombed compartment array, in essence, along the circumference of the platform structure 110 are adapted to be filled with suitable ballast material, such as compacted sand, iron ore, or compressible material such as expanded shale. The remaining, radially inwardly located compartments 122 may consist of oil storage compartments.

Located at suitable locations, as shown in FIGS. 8 and 9, are upstanding cylindrical walls 130 which encompass respectively riser shafts, utility shafts and drilling shafts. As in the embodiments of FIG. 1 the cylindrical walls 130 may rise above the top of the platform structure 110 and the remaining compartments to form supports or uprights for the production platform.

Within each of the nose sections 112 there are formed generally hemispherical compartments 132 which may also be filled with suitable ballast material analogous to ballast compartments 124,126 and 128.

The entire platform structure 110 is supported on a flat concrete slab 134 which rests on the marine bottom. A similar flat concrete slab may be provided on top of the structure, as in the previously described embodiment.

What is claimed is:

1. A gravity base offshore production platform structure including an above-water platform section and a support section extending from the marine floor to said platform section, said support section comprising:

at least one shaft extending from the marine floor to said platform section;

an array of vertically extending oil storage compartments; and an array of vertically extending ballast compartments about said oil storage compartments and said at least one shaft, said array of ballast compartments forming protruding scallop-like or starpoint portions about the periphery of said support section for absorbing maximum anticipated iceberg thrust forces and punching shear, whereby local punching failures as a result of iceberg impact are confined to said scallop-like or starpoint portions.

2. The structure of claim 1 wherein said support section is hexagonal in horizontal cross-section.

3. The structure of claim 1 wherein said ballast compartments have water therein.

4. The structure of claim 1 wherein said ballast compartments have sand or expanded shale aggregate therein.

5. The structure of claim 1 wherein said ballast compartments have iron ore therein.

6. The structure of claim 1 wherein at least one of said compartments projects vertically above said support section for supporting said platform section.

7. The structure of claim 1 wherein said scallop-like portions are parabolic in horizontal cross-section.

8. The structure of claim 1 wherein additional ballast compartments are located above at least some of said oil storage compartments.

9. The structure of claim 1 wherein said support section is formed of concrete.

10. The structure of claim 9 wherein said concrete is prestressed and reinforced concrete.

11. The structure of claim 1 wherein the outer walls of said scallop-like or starpoint portions are thicker than the remaining interior walls of said support section.

12. The structure of claim 1 further comprising reinforcing steel sheathing on the exterior of said scallop-like or starpoint portions.

13. The structure of claim 1 wherein there is provided a plurality of shafts extending from the marine floor interiorly of said support section to said platform section, said shafts being at least one of a drill shaft, a utility shaft or a riser shaft.

* * * * *